United States Patent [19]

McGee

[11] 3,989,795

[45] Nov. 2, 1976

[54] METHOD OF COMPRESSING CERAMIC REFRACTORY BODIES

[75] Inventor: Thomas D. McGee, Ames, Iowa

[73] Assignee: Iowa State University Research Foundation, Inc., Ames, Iowa

[22] Filed: May 1, 1975

[21] Appl. No.: 573,748

Related U.S. Application Data

[63] Continuation-in-part of Ser. No. 388,178, Aug. 13, 1973, which is a continuation of Ser. No. 154,414, June 18, 1971, abandoned.

[52] U.S. Cl. ..... 264/334; 264/332

[51] Int. Cl.[2] ..... B28B 7/00; B28B 3/02

[58] Field of Search ..... 264/60, 332, 65, 334

[56] References Cited

UNITED STATES PATENTS

| | | | |
|---|---|---|---|
| 2,968,837 | 1/1961 | Zeitlin et al. | 264/332 |
| 3,671,624 | 6/1972 | Antalek | 264/320 |
| 3,801,688 | 4/1974 | McGee | 264/322 |

*Primary Examiner*—Donald J. Arnold
*Assistant Examiner*—John A. Parrish

[57] ABSTRACT

This invention relates to a method of compressing ceramic refractory bodies which can be designated as "hot forging", as distinguished from "hot pressing", although both processes involve the compressing of formed porous bodies of ceramic refractory material to decrease their porosity and increase their strength. The hot forging process utilizes a breakaway mold having cooled die members. The porous ceramic body has been prepared for the compression by being heated to a pyroplastic temperature (viz. 1100°–1500° C.). It is rapidly compressed within the cold mold, a temperature gradient of the order of 1000° C. being maintained from the cooled inner die surfaces to a depth of not over 5 milliliters into the body from the die-contacted outer surfaces. While a thin porous skin is formed around the body, its thickness is limited to not over the depth of the temperature gradient. The body is released from the mold by separating the die members in directions perpendicular to the contacted sides of the body so as to limit abrasion of the outer surfaces of the body.

5 Claims, 6 Drawing Figures

Fig. 1
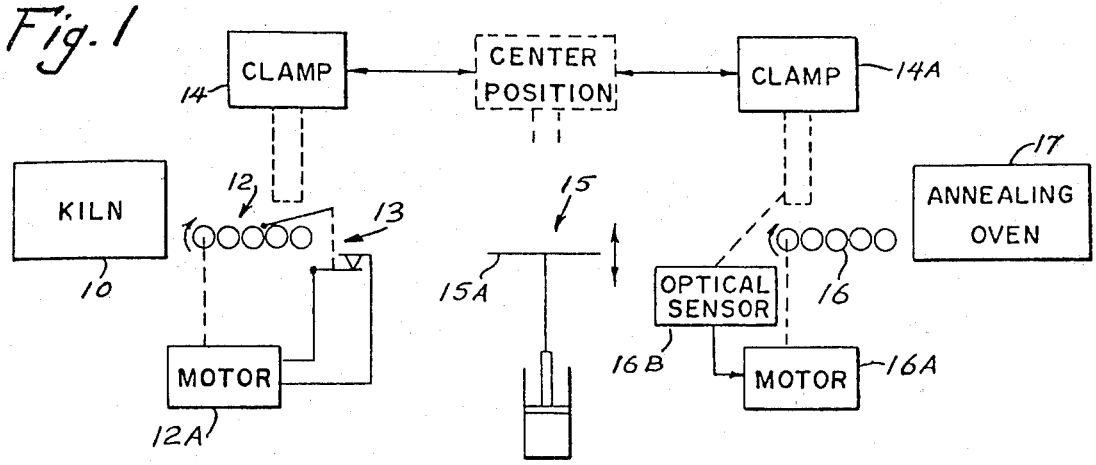
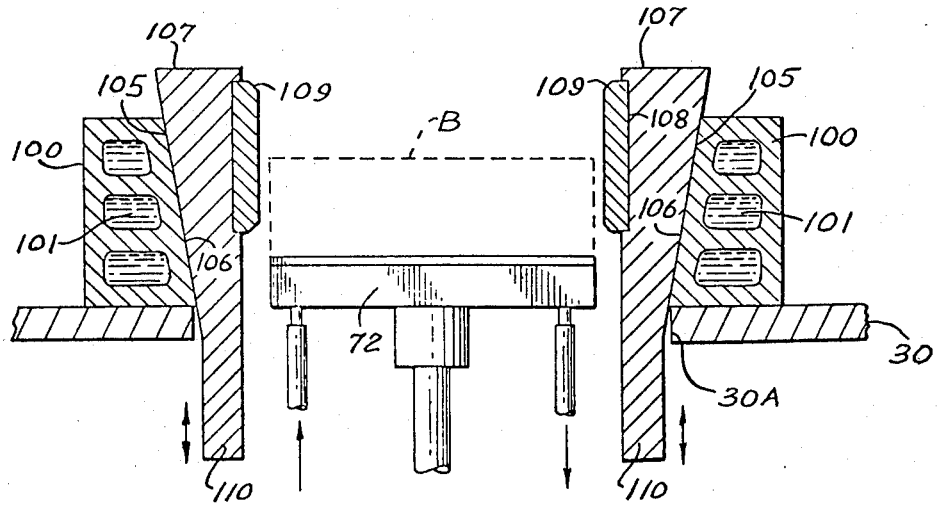
Fig. 6

METHOD OF COMPRESSING CERAMIC REFRACTORY BODIES

Cross-References

This application is a continuation-in-part of co-pending application Ser. No. 388,178, filed Aug. 13, 1973, which was a continuation of application Ser. No. 154,414, filed June 18, 1971, and now abandoned. Reference is also made to my application Ser. No. 882,591, filed Dec. 5, 1969 which was co-pending with said application Ser. No. 154,415, but now abandoned, and also to my application Ser. No. 210,946, filed Dec. 22, 1971, which was co-pending with both said applications Ser. Nos. 145,414 and 388,178, all abandoned. Insofar as applicable, the benefit of 35 U.S.C. Section 120 is claimed for the subject matter of this application in relation to each and all of the above-identified prior applications.

BACKGROUND AND SUMMARY

The present invention relates to a method for making refractory bodies; and more particularly, it pertains to a method for hot forging of ceramic refractory blocks. The materials with which the invention is concerned include all inorganic non-metallic ceramic materials which are characterized as having low thermal conductivity, and which exhibit fluid-like properties at high temperature. That is, at temperatures about 1100° depending on the material, some of the material is a highly viscous liquid and the remainder is solid. Such materials are referred to herein as "pyroplastic", and this term is not intended to exclude materials which are, in a strict sense, thermo-viscous. Examples include clays, feldspars, porcelain bodies and other silicates; periclase-$Al_2O_3$, periclase-iron, etc. Blocks of these materials are useful, for example, in the steel industry in the bed of a steel-making furnace.

Ceramic refractory materials are used in industrial furnaces because they have a high melting point and because they resist corrosive chemical attack by the liquid metals used in processing and by the slags that are present during processing. However, the strong chemical bonding which brings about the high melting point of a ceramic refractory material also makes them good electrical insulators, and they have the characteristic of great strength. Thus, the present invention has uses beyond the indicated preferred usage.

The manufacture of refractories usually begins with finely powdered material, either natural clays or chemical compounds, which are formed and then fired to produce the final product. Some applications of refractories, particularly in the steel industry, require resistance to corrosion by processing liquids. For this purpose, it is desirable that the refractories be completely pore free. Because of the nature of refractories, pores are present, and they may be thought of as two separate kinds. Some pores are closed or reticulated, while others are open and thus capable of being saturated from the outside with liquids they contact. Both kinds of pores contribute to the total porosity of a ceramic body and make it easier for corrosive liquid to penetrate and dissolve the refractory. Further, pores substantially reduce the load-bearing capability of a ceramic body.

The strength of ceramic materials is known to improve dramatically when the last few percent of pore volume is reduced or removed. Further, the load-bearing capacity and corrosion resistance of refractories at elevated temperatures (such as in steel-making furnaces) are often greatly improved by eliminating porosity.

Refractory ceramics may be made by processes wherein raw plastic material such as clays or grain-sized aggregates such as magnesia refractories are formed into a suitable shape and fired in a kiln. During firing, the volume shrinks. After removal from the kiln, the bodies are cooled to room temperature. In this process, the final finished product is invariably porous. The technology of raw material preparation, forming and firing, is highly developed but the porosity always remains in the order of 15–25 percent of the exterior volume of the piece.

Refractory blocks may also be formed by the sintering process which requires grinding the materials to produce very fine granules and firing to extremely high temperatures. Porosity of the finished block may be reduced to two to five percent, but there is a substantial shrinkage in the volume of the block. This process is expensive and there is poor dimensional control of the finished product.

In metallurgy, the term "hot forging" has been applied to the plastic deformation of a preheated metal blank, which is transferred from the preheat furnace, struck with one die into a second die, the dies being unheated and at a much lower temperature than the piece of metal being forged. Such hot forging of metals has been done with drop hammers, steam hammers, air rams, or quick-acting hydraulic rams. Sometimes multiple impacts are employed. The contact time for each impact is relatively short. Such "hot forging", as far as is known, has not been employed commercially for ceramic refractory materials.

High density ceramic refractorys are commercially manufactured by a method known as "hot pressing". In this method, the refractory bodies or blocks are fired to the required temperature in an oven and then pressure is applied while the blocks are still in the oven, so that the pressing dies are also hot. After the application of pressure, the blocks are permitted to cool to room temperature in a controlled environment.

The material most often used for the molds in hot pressing ceramic refractories is graphite because of its high hot strength and its ability to withstand the intense heat of the furnace. However, the graphite dies or molds wear out quickly because of the poor abrasion resistance of graphite. These molds also oxidize, thus resulting in destruction of the molds and a loss in the ability to control the size of the ceramic body during pressing. The wear problem is caused principally because the dies are brought into direct contact with the ceramic refractory material which is highly abrasive. Thus, the present commercial hot pressing process is expensive and produces high cost, specialized materials.

Some prior patents have suggested procedures for hot forging ceramic bodies (U.S. Pat. Nos. 1,809,214 and 1,809,215), including employing cool molds or rollers. In the preferred process of the cited patents, as described therein, the ceramic body is subjected to a series of rolling operations. Further, the references indicate that heated molds or rollers are preferably employed. The reason given is: "The molds might possibly be cold but are preferably hot, in order not to extract too much heat from the mass of material during the early stages of the molding operation." As far as is known, the procedures taught by the Pine et al patents have not been employed commercially, and there is no established process today for the hot forging of ceramic materials as distinguished from hot pressing procedures, which are carried out within ovens, and are subject to the disadvantages and limitations described above. Some improvements in hot pressing apparatus and procedures have been described. (See, for example, U.S. Pat. No. 3,303,533.) In the process and apparatus of the cited patent, silicon carbide rams are employed within the furnace for the molding operation rather than graphite, since it is stated that silicon carbide reduces heat loss from the ceramic body being compressed. Thus, the general teaching of the prior art with respect to the compression of ceramic bodies in a pyroplastic condition is to minimize heat loss, either by conducting the compression within a furnace, or by heating the mold or rolls which perform the compression.

In hot pressing, both wear and temperature contribute to the deterioration of the die surfaces. In a process of molding an abrasive powder, two different types of abrasion can be considered. The first occurs during the initial compression of the powder, and this involves movement of powder particles relative to the die walls as compression occurs. The greatest relative movement between the powder and the die walls occurs in the first stages of compression when the forces are relatively small. Thus, this type of wear is not severe.

The second type of wear occurs when the forging is removed from the die cavity. Normally, the side walls of the die cavity are formed as a rigid unit, and upper and lower die surfaces (or one of them) are pressed relative to each other to induce the compression force. The body is removed from the mold after the pressure is released by removing the top surface and then forcing the body from the rigid side surfaces by forcing the bottom die piece upwardly. Abrasion against the side surfaces is severe because the forging has become rigid and cooled somewhat. The side particles which had been forced tightly against the die side walls during compression are then translated parallel to the plane of the die side walls thus causing severe abrasion.

In hot forging, it appears that the movement of the forging from the die or mold is also a major source of die wear. Hence, the present invention has as one objective, the provision of a commercially feasible method of forging hot ceramic bodies wherein the wear experienced by the die surfaces is minimized, and the operating temperature of the die surfaces are greatly reduced.

In the method of this invention, ceramic bodies of the general shape in which they finally are desired can be delivered from a furnace to a roller conveyor. The bodies are porous and at a pyroplastic temperature. A lubricant may be applied to the surface of the block or to the surfaces of the mold. The block is picked up by means of a clamp and delivered to a hydraulic press. The press includes a mold comprised of a plurality of individual pieces, fitting together to form the desired shape and adapted to come together and break away rapidly. Each mold piece is provided with a hydraulic cylinder and piston rod unit, and all of the mold pieces act in combination to provide the mold for exerting pressure on the ceramic body, the interior of which is still incadescent. The pressure exerted on the body within the mold can be in the range of 2,000 to 10,000 psi; and it need be exerted for only a short period of time — of the order of a few seconds (viz. 1 – 5 seconds). The mold can then be broken apart and the mold pieces removed from the block except for one which supports it, and the travelling clamp is actuated to transport the block onto a second roller conveyor which feeds the block into an annealing oven.

The walls of the mold are cooled, but because they break away from the compressed body in a direction perpendicular to the surface of the body, sliding friction between the ceramic body and the mold surfaces is greatly reduced. Sliding friction, as used herein refers to the type of friction that results from rubbing two surfaces together. The body or the mold surfaces may be coated with a lubricant to further reduce friction between the block and the mold surfaces.

Because of the contact of the cold inner surfaces of the mold with the hot ceramic body during the compression, surface cooling of the body is inevitable. Such surface cooling would be expected to reduce the temperature of the body to below the pyroplastic temperature range, which would cause the cooled outer portions of the body to solidify without appreciable consolidation, the outer surface portions remaining porous and of relatively low density without strength increase. However, by the method of this invention, the compression can be carried out so rapidly that a high temperature gradient (viz. of the order of at least 1000° C.) can be maintained from the inner surfaces of the mold which contact the outer surfaces of the body being compressed to a depth corresponding to a mere "skin" around the body, such as to a depth of about 5 millimeters or less. Consequently, the resulting "skin" which retains its porosity, having been cooled by contact with the mold to a temperature below the pyroplastic temperature range of the body, has a correspondingly small thickness, that is, for example, a thickness of not over about 5 millimeters, such as a thickness of 1 to 5 millimeters.

Since the skin around the compressed body is not only thin, but also relatively smooth and unabraided, due to the procedure for opening the breakaway mold and releasing the body, as described above, in certain applications the compressed bodies, such as ceramic blocks or bricks, can be utilized without removing the skin, or further treatment of the outer surfaces of the bodies. Where desired, however, the skin can be removed by grinding, and, in some cases, grinding may also be desirable to improve the smoothness and dimensional uniformity of the bodies, such as with refractory blocks or bricks, used for constructing furnace walls.

THE DRAWINGS

FIG. 1 is a functional block drawing of an overall system including the present invention;

FIG. 6 is a schematic side view, partially in cross-section, of still another embodiment of a mold useable for practicing the present invention.

DETAILED DESCRIPTION

Figure 2:
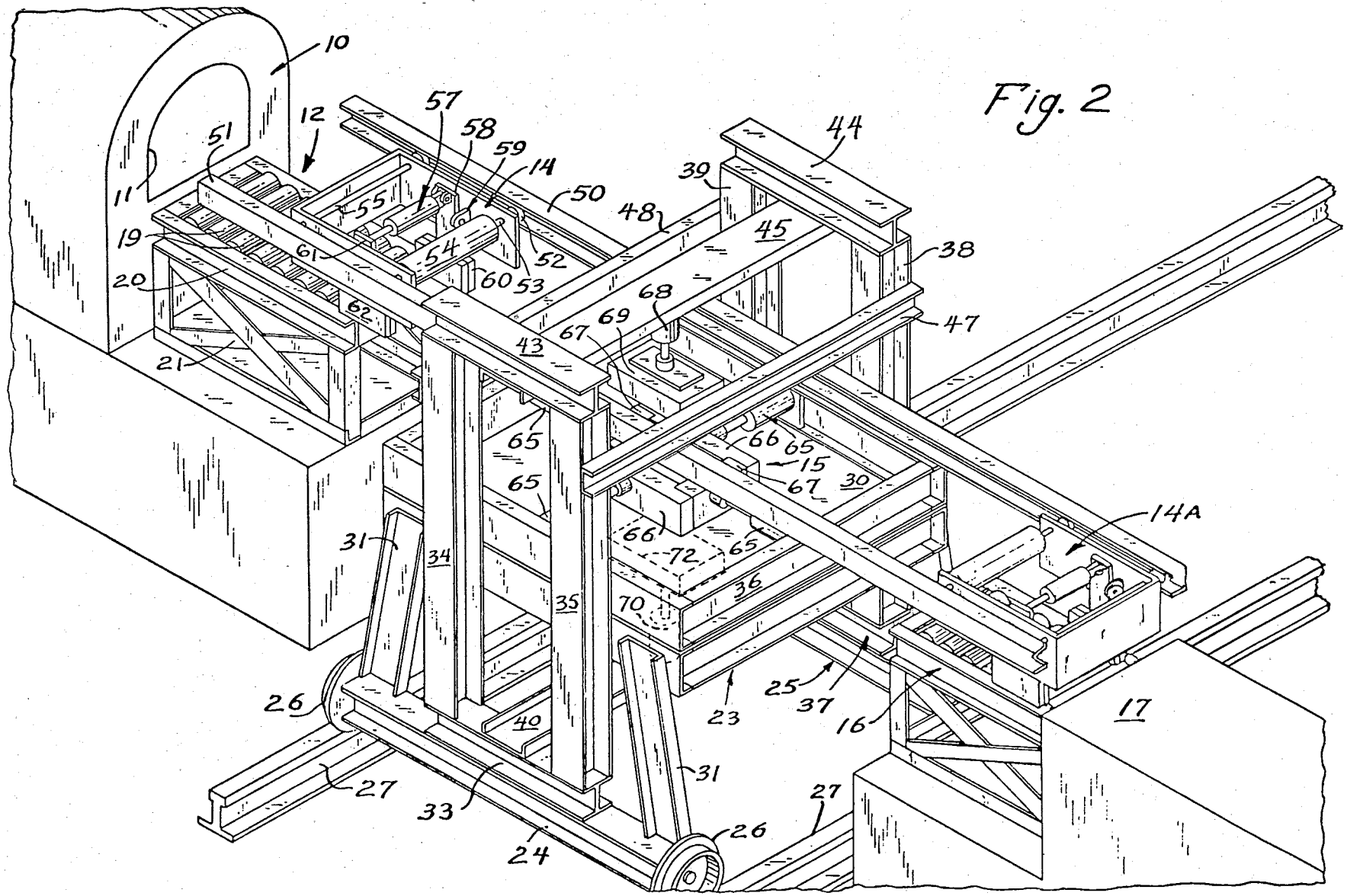
FIG. 2 is an isometric view of a method for forging hot ceramic bodies according to the present invention.

Looking first to FIG. 1, it is shown that hot ceramic bodies preformed into rectangular blocks are heated in a conventional kiln or oven designated by the block 10. The fired blocks are delivered from the kiln (via closable door 11 of FIG. 2) to a roller conveyor generally designated by reference numeral 12.

The conveyor 12 is powered by means of a motor 12A to a location below a travelling clamp 14. A limit switch 13 opens when a block is thus located to de-energize the motor 12A.

The blocks are then conveyed by the clamp 14 from the powered conveyor 12 to a center position over a mold area generally designated 15. The mold is a breakaway mold, as will be described in greater detail within, and it includes elevator means 15A adapted to receive the block from the clamp 14 and deliver it to the mold where it is pressed. After the block has been pressed, a second travelling clamp 14A then takes it from the elevator 15A and transports it to a powered output roller conveyor 16 from which the blocks are moved into an annealing over 17. The conveyor 16 is powered by a motor 16A; and an optical sensor 16B (or equivalent means) generates a signal when a block is present to start the motor 16A.

Turning now to FIG. 2, the input roller conveyor 12 includes a plurality of steel rollers 19 rotatably mounted within a frame 20 which is supported on a base 21. As the bricks are delivered from the furnace 10, they are transported by the rollers 19 which are driven by the motor 12A in a conventional manner to a location beneath the clamp 14.

The mold 15 is supported in a large, massive, table having a steel frame generally designated by reference numeral 23 and including two lower I-beams 24 and 25 which are axles provided with side wheels 26 received on rails 27 for positioning the mold. A generally rectangular bed 30 defining a central aperture 30A is supported horizontally by means of legs 31 which are connected to the axles 24, 25. The legs 31 may be formed of channel-shaped steel beams.

A pedestal I-beam 33 is welded to the top of the axle 24, and extending upwardly from the pedestal 33 are two vertical I-beams 34 and 35. The bed 30 has a peripheral frame 36, also formed of channel-shaped steel beams, and the frame 36 may be welded to the upstanding beams 34, 35. Similarly, a pedestal 37 is formed on the axle 25, and provided with two vertical I-beams 38 and 39. A horizontal channel member 40 extends between the upper surfaces of the pedestals 33, 37 and between the four upright beams 34, 35, 38 and 39.

An I-beam 43 is secured to the top of the upright beams 34, 35 and a similar I-beam 44 is secured to the tops of the beams 38, 39. A frame member 45 is connected between the centers of the I-beams 43, 44 so as to extend across the bed 30 above the mold area 15. To the sides of the beams 35, 38, there is a channel frame member 47; and a similar channel frame member 48 is secured to the sides of the beams 34, 39. The channel frame members 47, 48 serve as supports for two tracks identified by reference numerals 50 and 51 respectively. Each of the tracks 50, 51 is a U-shaped channel member with the open portions facing each other so as to provide a track for the travelling clamp 14 between a position above the input roller conveyor 12 and the roller conveyor 16 leading to the annealing oven 17.

The traveling clamp 14 includes a pair of front wheels (one of which is designated 52 in FIG. 2) received respectively within the side tracks 50, 51 and mounted on a common axle 53. The axle 53 is driven by a reversible motor 54. The traveling clamp 14 is also provided with a similar pair of rear wheels mounted on an axle 55 and received respectively in the side tracks 50, 51. Located in the center of the traveling clamp 14 is a cylinder and piston rod unit generally designated 57 and having its cylinder end pivotally mounted to a vertical plate 58 which is trunnion-mounted as at 59 to the frame of the traveling clamp 14. The plate 58 extends below the side rails 50, 51 and is provided with a lower clamping pad 60 of ceramic or other refractory material. Similarly, the rod of the cylinder and piston rod unit 57 is mounted to a vertical plate 61 pivotally mounted on the other side of the frame of the traveling clamp 14 and provided at its lower end with a pad 62.

When a block trips the limit switch 13 to shut off the motor 12A, the cylinder and piston rod unit 57 is actuated to extend, the clamping pads 60, 62 move inwardly to engage the block, and the motor 54 is then actuated to carry the block to the center position above the molding area along the side tracks 50, 51. Preferably all of these operations are automated according to convention techniques.

In the molding area there are four hydraulic cylinder units 65, and each has its cylinder firmly mounted to the center of one side of the rectilinear frame 36 of the bed 30, for moving the mold sides (or dies) in position to form an enclosure for the compressing operation. One pair of opposing hydraulic cylinder units 65 is provided with similar mold pieces, and these are designated 66, whereas the other opposing pair of hydraulic cylinder units 65 are provided with identical mold pieces 67 which are different than the mold sides 66, as will be explained below.

A top hydraulic cylinder unit 68 has its cylinder connected to the transverse center of the upper frame member 45, and it is provided with a mold piece 69. Similarly, a bottom hydraulic cylinder unit 70 has its cylinder rigidly secured to the lower transverse frame member 40, and this unit comprises the elevator means 15A mentioned above. The rod end of the cylinder unit 70 is connected to a bottom mold piece 72 which is arranged to move through the aperture 30A in the bed 30 of the table to receive the block from the clamp 14.

After the cylinder unit 70 has lowered the block to a predetermined position where it sides or walls are aligned with the side mold pieces 66, 67, the mold is actuated to press the block. The side mold pieces maintain the plan shape of the block, and the upper and lower mold pieces compress the top and bottom of the block to reduce its volume. This may be accomplished automatically with conventional limit switches and controls, or by an operator controlling the flow and return of pressurized fluid to the hydraulic cylinder units, which are all double-acting units.

Figure 5:
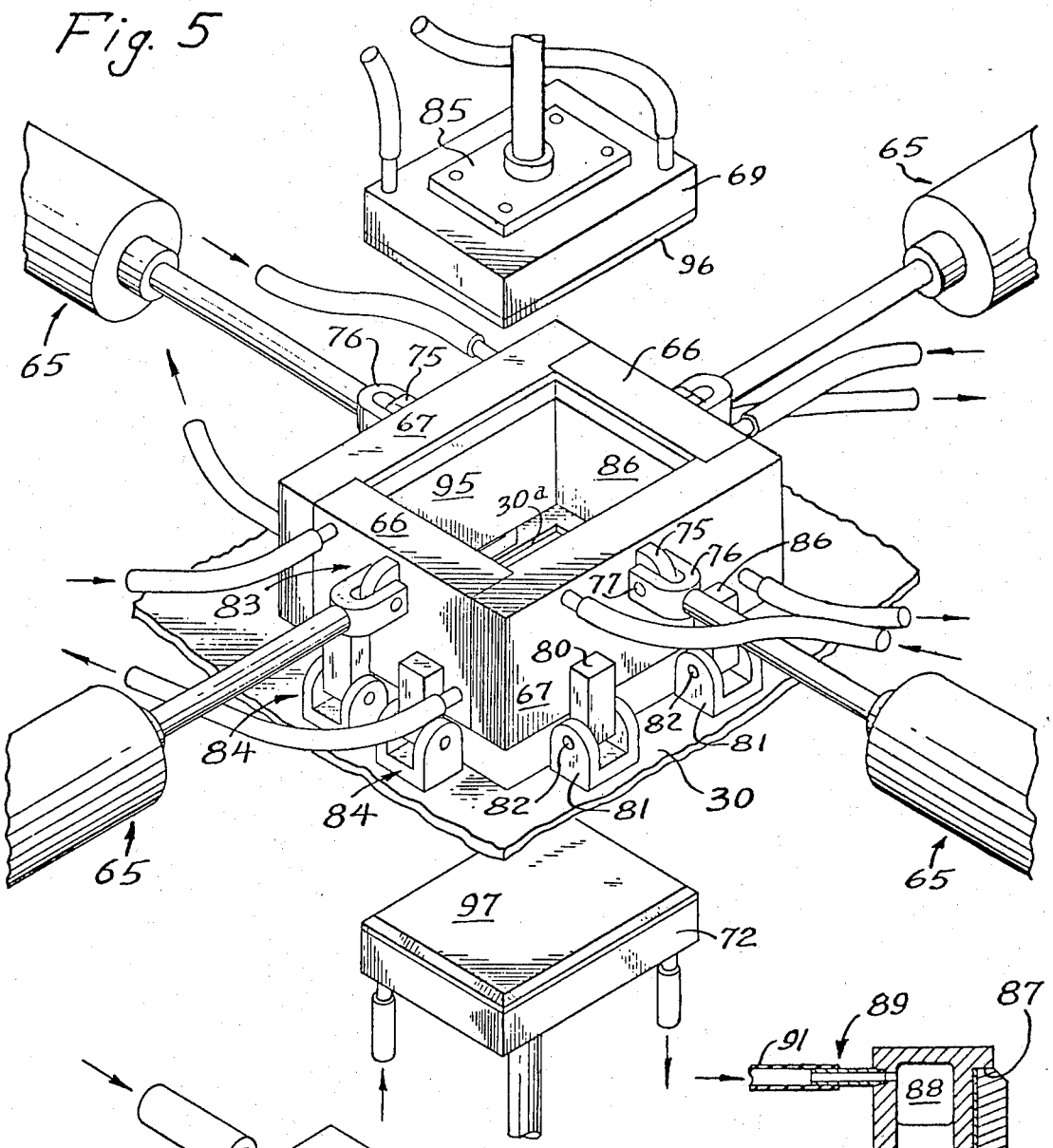
FIG. 5 is a close-up isometric view of one alternative construction for the mold.

Turning now to FIG. 5, the details of an alternate mold construction are shown. Those elements which are common to the embodiment of FIG. 1 are repeated and denoted by the same reference numerals. Referring first to the mold pieces 67, each contains an apertured projection 75 which is received within a yoke 76 connected to the rod end of their associated cylinder units 65. A pin 77 pivotally connects the projection 75 with the yoke 76. At the lower side of each of the mold sides 67 there are secured depending legs 80 which are received in trunnions 81 attached to the bed 30 of the mold table. Transverse pins 82 pivotally connect the legs 80 to the trunnions 81. The slots in the trunnions 81 which receive the pins 82 may be elongated slightly horizontally so as to permit retraction and engagement by the mold side 67 along a horizontal direction to reduce sliding friction between the mold surface and the block. — i.e., the mold pieces move along a line perpendicular to the plane of the side of the block that they engage.

Similarly, the mold pieces 66 in this emobidment are pivotally connected as at 83 to their associated piston rods, and the bottom of each mold side is pivotally connected to the upper surface of the table bed 30. The back of the upper mold piece 69 is provided with a mounting plate 85 which receives its associated piston rod in a non-pivotal connection, although this is not critical to the operation of the invention. The lower mold piece 72 is similarly connected to its associated piston rod.

Figure 3:
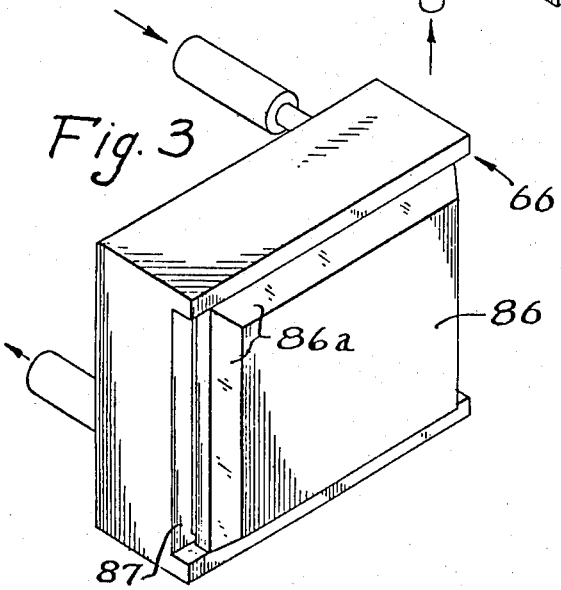
FIG. 3 is a close-up perspective view of one mold of FIG. 1.
Figure 4:
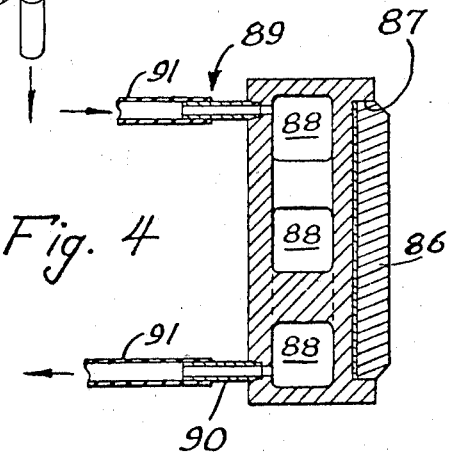
FIG. 4 is a transverse cross-sectional view of the mold piece of FIG. 3.

Turning now to the mold side 66 (of both embodiments) as seen in FIG. 3, the inner side thereof is provided with a cavity 87 which receives a matching liner 86. The body of the mold side 66 made of soft iron, and it is thus adapted to receive a die surface 86 which is made of an abrasion resistant steel, such as hardened tool steel. Such steels are much less expensive then graphite but when used cold can resist abrasion by the ceramic body being pressed.

Further, there are a plurality of internal conduits 88 which communicate with each other and through which a cooling fluid such as cooling water is forced via an inlet conduit 89 and an outlet conduit 90 to which are connected flexible hoses 91. The sides of the liner 86 are beveled as at 86*a* to form a mating, sealing contact with the four adjacent liners that it engages. The other mold sides 67 are similarly provided with liners 95, except that the liners 95, in order to form a sealed mold with the adjacent liners 86 do not extend the full length of their associated backing members 67.

The upper mold piece 69 is provided with a similar hardened tool steel liner 96, and the bottom mold piece 72 is similarly provided with a hardened tool steel liner 97. All of the mold pieces are cooled in the manner described.

Turning now to FIG. 6, there is schematically shown an alternative embodiment of the mold wherein solid, water-coolled backing members are designated 100, and they are rigidly fastened to the bed 30. The water is forced through conduits 101 of the backing members 100. Each of the backing members 100 has an inclined bearing surface 106 of mold support pieces 107. Each of the mold support pieces 107 is provided with a cavity 108 for receiving a liner 109 similar to the previously-described liners 86 and 95. The mold support pieces 107 are provided with lower extensions 110 which are pivotally connected to hydraulic cylinder piston rod units (not shown) for movement in a vertical direction. When the mold support pieces 107 are moved upwardly, the mold is in an open position, permitting passage of the lower mold member 72 bearing the block which is shown in dashed line and denoted capital letter B.

After the block has been lowered to a predetermined elevation, the side mold sections 107 are also lowered, and this lowering action closes the sides of the molds because of the camming action caused by the inclined mold backing surface 105. After the mold sides are cloased, the upper (not shown) and lower mold pieces are forced against the upper and lower surfaces of the block B to exert the desired pressure.

Referring to the embodiment of FIG. 2, when the heated blocks are delivered to the input roller conveyor 12, they are at a pyroplastic temperature. Depending upon the material, typical pyroplastic temperatures can be in the range of about 1100° C. to 1500° C. The blocks are incandescent at this time. A block is then transferred by means of the traveling clamp 14 to the mold area and rested upon the liner 97 of the lower mold piece 72. The clamp 14 is then returned. The upper hydraulic cylinder unit 68 is actuated to lower the top mold piece 69; and the side hydraulic cylinder units are also actuated to cause their associated side mold pieces to engage the block. After the mold is closed, uniform pressure is applied to all of the hydraulic cylinder units to pressurize the block to the desired pressure — in the range of 2,000 to 10,000 psi, again depending upon the material used and the degree of porosity that can be tolerated in the final product. The pressure is applied only for a period in the range of a few seconds (viz. 1 – 5 seconds) while the mold pieces are continuously cooled by forcing water through their associated inner conduits.

The time period of pressure application is long enough to cool the first few millimeters (about 5 millimeters or less) of the block's surface to a temperature below the pyroplastic range, thereby forming a thin porous skin. The time period of pressure application should be short enough to prevent much heating of the inner surfaces of the mold pieces. Preferably, the inner surfaces of the mold pieces are kept below 250° C., such as in the range of 100° – 200° C. This time period for the compression can be in the range of one to five seconds. The pressure can then be released until the mold sides are removed from contact with the block, and the traveling clamp 14A picks up the block at the mold area and delivers it to the roller conveyor 16 from whence it is transferred to the annealing oven 17.

It may be desirable, in certain cases, to spray the surface of the block with a lubricant such as potassium lead silicate glass prior to pressing. Alternatively, the surfaces of the mold could be lubricated with graphite, silicon oil or petroleum oil. Because of the low thermal conductivity of the ceramic material and the short time of contact, a very steep temperature gradient is set up between the contacted outer surface of the block and the incandescent interior of the block. The thin skin of cooled and still porous refractory material which forms is of the order of a few millimeters in depth (viz. 1 – 5 millimeters), corresponding to the depth of the temperature gradient (about 5 millimeters or less). Inwardly, of the skin layer, the body remains in pyroplastic condition and can be compressed to effectively reduce the porosity and increase the strength of the body.

The cooled block skin will still be porous, but, if desired, it can be removed either chemically or by grinding. But, the thickness of the skin can be controlled while the incandescent interior is forged. Because of the low thermal diffusity of the ceramic material, a steep temperature gradient may be maintained, the body or block being cooled only over a short distance inwardly from the surface. For example, a temperature gradient of about 1000° C. over a few millimeters (5 millimeters or less) enables the formation of a thin cooled skin while maintaining the interior of the block in a state of pyroviscosity. This gradient is from the inner cooled surface of the mold walls which contact the outer surface of the body, that is, a temperature difference of the order of 1000° C. can be maintained by rapid compression from the outer surfaces of the body to depths of not over about 5 millimeters into the body.

It may also be desirable to add additional cooling medium directly to the surface of the block prior to pressing — for example, while the block is on the powered input roller. Such cooling may be particularly helpful in preventing bloating or other deformation of the blocks after the pressure of the mold has been released. The structure of the mold permits consolidation of the volume of the block while maintaining a sealed mold, and one which breaks away into a plurality of separate pieces to facilitate removal of the block without sliding abrasive action on the mold surfaces.

By cooling the mold, and by providing mold pieces of high thermal diffusivity, the mold does not reach excessive temperatures which I have found to be detrimental to long usage. The lubrication of the block prior to pressing further alleviates sliding frictional abrasion thereby further reducing wear on the liners. The rapid handling and forming of the block inhibits heat transfer by conduction to the mold sides, and transportation of the hot blocks is facilitated to and from the mold by means of the traveling clamps. When the mold is provided with sufficient cooling to prevent overheating of the dies, on completion of the compression, the block can be held in the mold for an additional few seconds to increase its dimensional stability on removal. The depth of the porous skin will not be increased, since the compression has substantially eliminated the internal porosity of the ceramic material.

The compressed block on removal from the mold can be subjected to further known processes such as annealing. Usually, annealing is designed to relieve stress within the block, and assist in maintaining dimensional stability. In annealing the heating is at temperatures below the pyroplastic range of the ceramic material. Consequently, annealing will not affect or remove the skin from the bodies or blocks. As indicated previously, however, the skin can be removed by known operations such as grinding. A subsequent heat treatment of the bodies or blocks may also be for the purpose of removing the liquid phase which is necessarily present during the compressing operation. Special procedures for forming and removing such liquid phases in connection with hot forging are described in my U.S. Pat. No. 3,801,688, which issued on application Ser. No. 210,946, cited under Cross-Reference.

I claim as my invention:

1. The method of compressing a formed porous body of ceramic refractory material to decrease its porosity and increase its strength, said compressing being carried out in a mold having inwardly movable wall means to exert the compressing force on the body, said porous ceramic body being at a pyroplastic temperature in the range of about 1100° to 1500° C. during said compressing, wherein the improvement comprises:

a. utilizing as said mold a breakaway mold providing oppositely-disposed separable die members defining the walls of the mold, said die members having inner surfaces which contact said body during said compression formed of an abrasion resistant steel, and said die members being provided with internal cooling passage means in heat exchange relation with said die inner surfaces;

b. compressing said porous ceramic pyroplastic body within said breakaway mold while circulating a cooling fluid through said die passage means to cool said inner die surfaces, said compression being carried out so rapidly that a temperature gradient of the order of at least 1000° C. is maintained from said cooled inner die surfaces to a depth of about 5 millimeters or less into said body from the die-contacted outer surfaces thereof, whereby a thin porous skin is formed around said body which is limited in thickness to said depth; and c. releasing the pressure on said body and opening said mold by separating said oppositely-disposed die members in directions perpendicular to the respective contacted sides of said body so as to limit sliding friction between said body and said mold as it is released therefrom.

2. The method of claim 1 in which said improvement is further characterized by the fact that said body is a flat-sided block of rectilinear configuration.

3. The method of claim 1 in which said improvement is further characterized by the fact that said compressing is carried out in about 1 to 5 seconds.

4. The method of compressing a porous block of ceramic refractory material to decrease its porosity and increase its strength, said compressing being carried out in a mold having inwardly movable side means to exert the compressing force on the block, said porous ceramic block being at a pyroplastic temperature in the range of about 1100° to 1500° C. during said compressing, wherein the improvement comprises:

a. utilizing as said mold a breakaway mold providing oppositely-disposed separable die members defining the walls of the mold, said die members having their inner surfaces which contact said body during said compression formed of hardened tool steel, and said die members being provided with passage means in heat exchange relation with said die inner surfaces;

b. compressing said porous ceramic pyroplastic block within said breakaway mold under pressures of the order of 2000 to 10,000 psi while circulating a cooling fluid through said die passage means to cool said inner die surfaces, said compressing being carried out so rapidly that a temperature gradient of the order of 1000° C. is maintained from the die-contacted outer surfaces of said die surfaces block to a depth of about 5 millimeters or less into said block from said outer surfaces, whereby a thin porous skin is formed around said block which is limited in thickness to said depth; and c. releasing the pressure on said body and opening said mold by separating said oppositely-disposed die members in directions perpendicular to the respective contacted sides of said block, so as to limit sliding friction between said body and said mold as it is released therefrom.

5. The method of claim 4 in which said improvement is further characterized by the fact that said compressing is carried out in about 1 to 5 seconds.

* * * * *